United States Patent [19]

Mundell

[11] Patent Number: 4,576,242

[45] Date of Patent: Mar. 18, 1986

[54] PERISTALTIC DOWN-HOLE DRILLING MOTOR

[75] Inventor: Richard H. Mundell, Rijswijk, Netherlands

[73] Assignee: Shell Oil Company, Houston, Tex.

[21] Appl. No.: 641,636

[22] Filed: Aug. 17, 1984

[30] Foreign Application Priority Data

Oct. 26, 1983 [GB] United Kingdom ..... 8328633

[51] Int. Cl.[4] ..... E21B 3/12; F04B 43/08

[52] U.S. Cl. ..... 175/107; 175/323; 417/477

[58] Field of Search ..... 175/100, 107, 93, 113, 175/323, 322; 417/477

[56] References Cited

U.S. PATENT DOCUMENTS

| | | | |
|---|---|---|---|
| 3,039,442 | 6/1962 | Hornschuch | 417/477 |
| 3,304,838 | 2/1967 | McDonald | 175/100 X |
| 3,732,042 | 5/1973 | Buchholz | 417/477 |
| 3,749,531 | 7/1973 | Walker et al. | 417/477 X |
| 4,105,377 | 8/1978 | Mayall | 175/107 X |

FOREIGN PATENT DOCUMENTS 595535 2/1978 U.S.S.R. .

*Primary Examiner*—John M. Jillions
*Assistant Examiner*—Thomas R. Hannon

[57] ABSTRACT

A peristaltic down-hole drilling motor comprises a series of breathing working chambers that are formed between a membrane and a tubular section of the stator of the motor.

The rotor comprises a plurality of rollers that are rotatably supported in grooves of a carrier body such that the rollers press the membrane at selected intervals against said tubular section.

The working chambers are designed such that during operation of the motor the rollers are actuated to ride upon the membrane in front of the expanding portions of the chambers, thereby rotating the rotor relative to the stator.

18 Claims, 4 Drawing Figures

FIG. 3
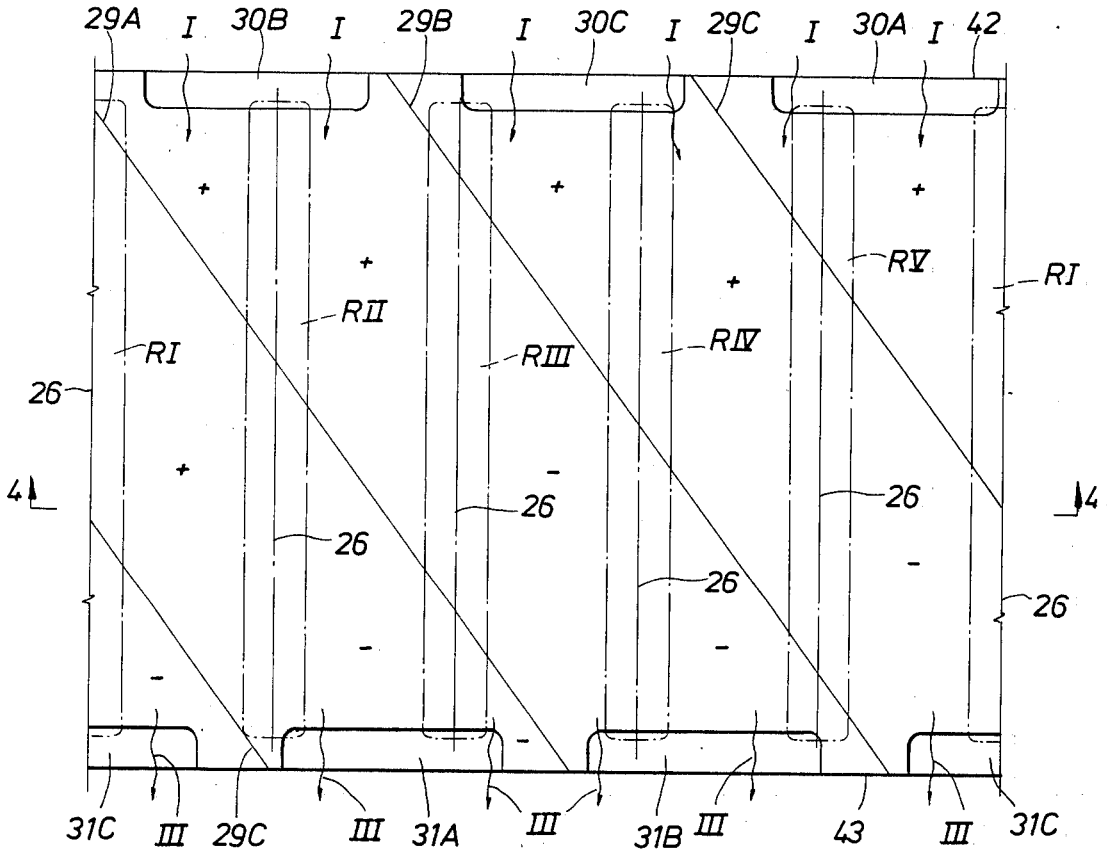
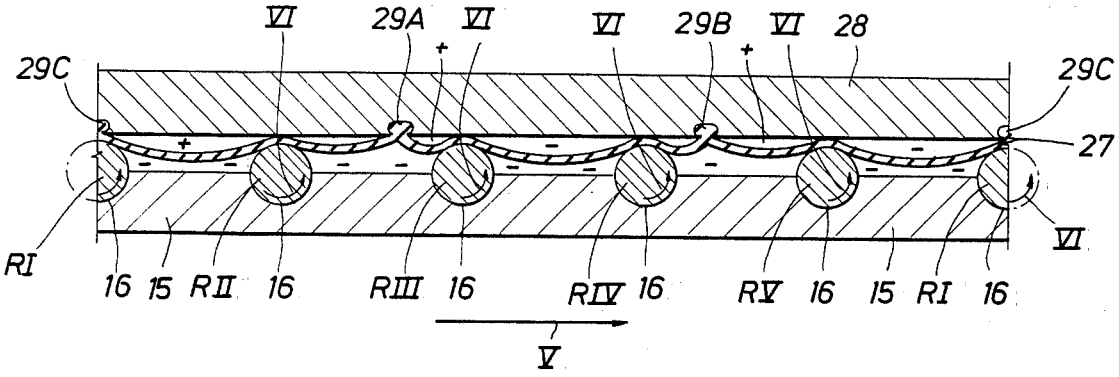
FIG. 4

PERISTALTIC DOWN-HOLE DRILLING MOTOR

BACKGROUND OF THE INVENTION

1. Field of the Invention

The invention relates to a hydraulic down-hole motor of peristaltic type for use in underground drilling operations.

2. Description of the Prior Art

Down-hole motors are used in drilling operations for driving a drill bit or other rotary tools. The motors usually comprise a stator which is suitable to be coupled to the lower end of a drill string and a rotor which is driven by the flow of drilling liquid to the drill bit. Examples of such motors are the hydraulic turbines and the positive-displacement motors, such as the vane motor. An advantage of the positive-displacement motors over the turbines is that the speed of rotation of the rotor can be controlled accurately by varying the flow of drilling fluid through the drill string. A drawback of the currently used down-hole motors of the positive-displacement type is that in particular those parts of the stator and rotor that contact each other are subject to high wear, such that the operational period of these motors is rather low.

A positive-displacement motor of the peristaltic type has the advantage over other types of positive-displacement motors in that wear of the motor during operation thereof is extraordinarily low. Motors of the peristaltic type are known per se. A motor of this type comprises a series of "breathing" working chambers that are formed between an impermeable membrane and a tubular section of the stator housing. The rotor comprises a set of rollers that press the membrane at selected intervals against the tubular stator section. The working chambers are designed such that during operation of the motor the rollers are driven to ride upon the membrane in front of the expanding portions of the chambers, thereby rotating the rotor relative to the stator. Such peristaltic motors are disclosed in the specifications of U.S. Pat. No. 3,039,442 entitled "Motor Operative By Action Of A Fluid Expansible Membrane", filed Dec. 1, 1960 by Hanns Hornschuch and Jack R. Webb, Ser. No. 73,039, and of USSR Pat. No. 595535. The known peristaltic motors, however, are designed for above ground operations and are not suitable to be used down-hole due to their general configuration, in particular due to their low volume-diameter ratio.

It is to be understood that down-hole motors should have typically a rather high volume-diameter ratio since considerable power is required to drive a drill bit which requires a motor with a large displacement volume, whereas the motor is to be inserted in small-diameter boreholes.

It is virtually impossible to increase the volume-diameter ratio of the known peristaltic motors to a sufficient extent for downhole use thereof, since in these motors the rollers are mounted on satellite shafts that are supported at the ends thereof by bearings being carried by a central rotor body. A large increase of the volume-diameter ratio of the motors would require the use of elongate rollers and satellite shafts. Such elongate shafts might easily be bent under the forces exerted thereon by the rollers, which would impair the proper operation of the motor.

SUMMARY OF THE INVENTION

The primary object of the present invention is to provide a motor of the peristaltic type which is suitable to be used in down-hole drilling operations.

In accordance with the invention this object is accomplished by a peristaltic motor comprising a stator suitable to be coupled to the lower end of a drill string and a rotor suitable to be coupled to a drill bit, said motor parts being rotatable relative to each other about a central axis, one of said motor parts comprising a co-axial tubular section and a membrane being secured to said section in such a manner that therebetween a series of breathing working chambers are created, the other of said motor parts comprising a carrier body and a plurality of rollers contacting the membrane at regular intervals with said tubular section wherein the rollers are rotatably supported in grooves of the carrier body such that each roller is rotatable relative to said body about an axis of rotation being substantially parallel to the central axis of the motor.

The invention may be carried into practice in a number of ways but one specific embodiment will now be described by way of example with reference to the accompanying drawing.

BRIEF DESCRIPTION OF THE DRAWING

FIG. 3 is a schematic view of the working chambers of the motor of FIG. 1, the chambers being shown in an "unrolled" position thereof; and FIG. 4 is a cross-sectional view of the unrolled working chambers of FIG. 3, seen along line 4—4.

DESCRIPTION OF THE PREFERRED EMBODIMENT(S)

Figure 1:
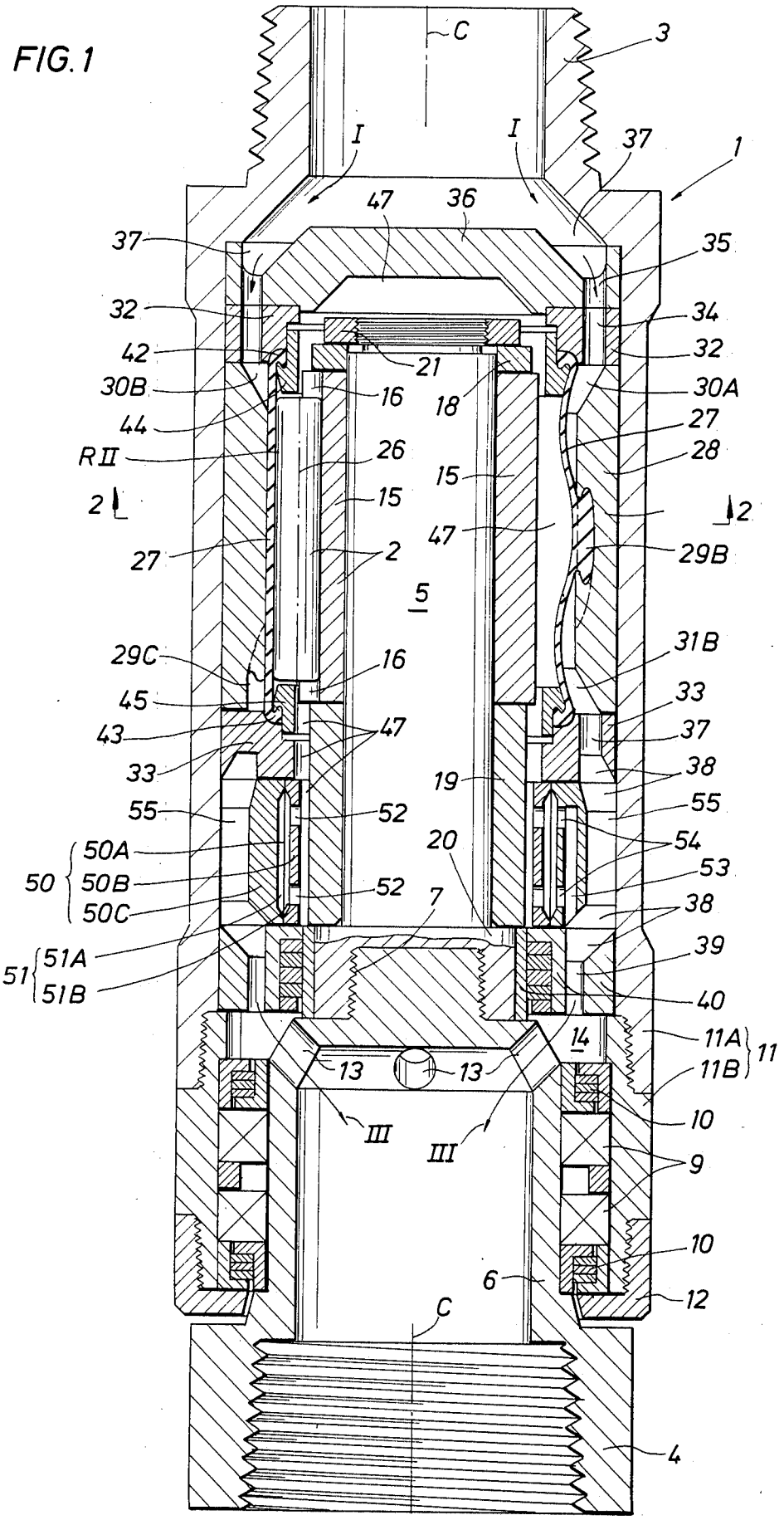
FIG. 1 is a longitudinal sectional view of a peristaltic motor embodying the invention.

In FIG. 1 there is shown a peristaltic drilling motor comprising a stator 1 and a rotor 2 being rotatable relative to the stator 1 about a central axis C—C. The stator 1 is at the upper end thereof provided with a pin tool joint 3 for coupling the motor to the lower end of a drill string (not shown). The rotor 2 is at the lower end thereof provided with a box tool joint 4 for connecting a drill bit (not shown) thereto.

The rotor 2 comprises a central shaft 5 and an output shaft 6, which shafts are co-axially arranged and interconnected by means of a screw thread coupling 7. The output shaft 6 is supported by means of an assembly of schematically represented radial and thrust bearings 9. The bearing assembly 9 is separated from the mud flow through the motor by sealing elements 10. In order to allow replacement thereof the assembly 9 is mounted in a tubular lower housing section 11A, which is at the upper end thereof screwed to the upper part 11B of the motor housing 11 and which is screwed at the lower end thereof to a terminal ring 12. To allow passage of mud via the output shaft 6 to a drill bit (not shown), this shaft 6 is provided with four bores 13 that form a fluid communication between the interior of the hollow lower part of the shaft 6 and an annular space 14.

The rotor 2 further comprises a bronze carrier body 15 and a set of five elongate cylindrical steel rollers RI, RII, RIII, RIV, and RV (see also FIG. 2) that are rotatably supported in axially extending grooves 16 of the carrier body 15 in such a manner that they are each rotatable relative to the carrier body 15 about an axis of rotation 26 parallel to the central axis C—C. The carrier body 15 is mounted on the central shaft 5 between two spacer rings 18 and 19. The rings 18, 19 and the carrier body 15 are clamped to each other in axial direction between a shoulder 20 near the lower end of the shaft 5 and a nut 21 which is screwed to the upper end of the shaft 5.

Figure 2:
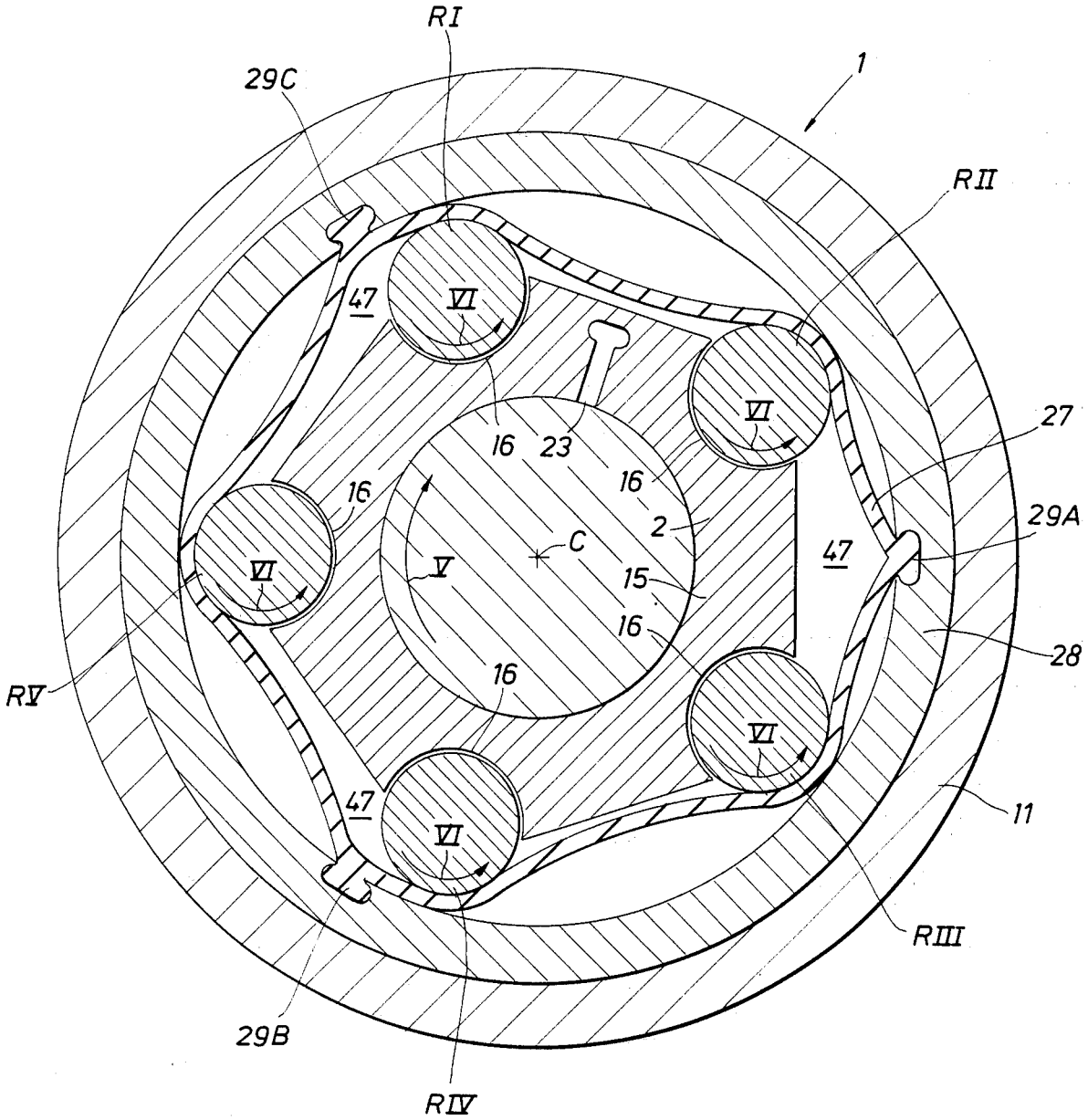
FIG. 2 is a cross-section of the motor of FIG. 1 taken along the line 2—2.

As illustrated in FIG. 2 the carrier body 15 is provided with at least one axially extending slot 23 to allow easy installation thereof on the central shaft 5. The rollers RI–RV contact at regular circumferential intervals a membrane 27 forming part of the stator 1 thereby pressing the membrane locally against a co-axial tubular stator section 28. The membrane 27 is secured to the tubular section 28 by means of three helically shaped longitudinal beads 29A–C in such a manner that a series of three tangentially spaced expandable working chambers CI–CIII is created between the membrane 27 and the section 28, which chambers CI–CIII have the shape of helical strips (see also FIG. 3). The working chambers CI–CIII are each provided with tangentially spaced inlet and exhaust ports 30A–C and 31A–C, respectively. The inlet ports 30A–C are formed at the upper end and the exhaust ports 31A–C at the lower end of the tubular section 28. The tubular section 28 is arranged between an upper and a lower terminal ring 32 and 33, respectively. The upper terminal ring 32 is provided with a series of axial bores 34 that open at the lower ends thereof into the inlet ports 30A and that are at the upper ends thereof in communication with corresponding bores 35 being formed in a terminal disc 36. The disc 36 is shaped in such a manner that a fluid passage 37 communicating with the bores 35 is created, thus allowing drilling mud to flow from the interior of the drill string (not shown) via the fluid passage 37 and the bores 35, 34 to the inlet ports 30A–C, as indicated by arrows I. The lower terminal ring 33 comprises a series of axial bores 37 that communicate at the upper ends thereof with the exhaust ports 31A–C and that communicate at the lower ends thereof with an annular fluid channel 38. The channel 38 is in fluid communication with the annular space 14 via a series of axial bores 39 that are formed in the outer ring of a sealing assembly 40. In this manner a fluid communication is created between the exhaust ports 31A–C and the annular space 14 that communicates with the interior of the output shaft 6 via the bores 13, thus allowing passage of drilling mud from the exhaust ports 31A–C to the interior of the output shaft 6 (see arrows III).

The membrane 27 is at the upper and lower ends thereof provided with circular terminal beads 42 and 43, respectively. The upper terminal bead 42 is clamped between the upper terminal ring 32 and an upper support ring 44, and the lower terminal bead 43 is clamped between the lower terminal ring 33 and a lower support ring 45. The support rings 44, 45 and the corresponding terminal rings 32, 33 are co-axially arranged and interconnected by a series of axially extending bolts (not shown)in order to exert an appropriate, adjustable, clamping force to the beads 42, 43. The axial distance between the upper and lower distance ring 44 and 45 is selected slightly longer than the length of the rollers RI–RV so as to allow performance of these rings 44, 45 as axial guide means for the rollers RI–RV.

The substantially bell-shaped space 47 being present between the stator 1 and the upper part of the rotor 2 is filled with a lubricant, such as oil.

The liquid pressure of the lubricant in the space 47 is equalized to the mud pressure in the outlet ports 31A–C by means of a pressure equalizing unit 50. This unit 50 is mounted between the lower terminal ring 33 and the outer ring of the sealing assembly 40. The unit 50 comprises a flexible membrane 50A which is at the upper and lower ends thereof clamped between two co-axial clamping rings 50B and 50C, which rings 50B, 50C are shaped such that an annular cavity 51 is created therebetween, which cavity is divided by the membrane 50A into an outer cavity 51A and an inner cavity 51B. The inner cavity 51B is filled with lubricant and communicates with the space 47 via radial bores 52 in the inner clamping ring 50B. The outer cavity 51A is filled with mud and communicates with the annular fluid channel 38 via axial and radial bores 53 and 54, respectively, in the outer clamping ring 50C. The outer clamping ring 50C is further provided with radially extending stabilizer fins 55 extending through the annular fluid channel 38 for centralizing the unit 50 in the stator housing 11. Since the operation of pressure equalizing units is known per se and the construction of such units is described in detail in U.S. Pat. No. 3,741,321, entitled "Means To Prevent Inward Leakage Across Seals In A Well Tool", filed May 20, 1971, Ser. No. 145,373, authored by Vasel R. Slover, Jr., Daniel E. Hawk, and Jack C. Brady, no details on the operation and construction thereof are given in this specification.

It will be understood that the primary purpose of the pressure equalizing unit 50 is to control the pressure difference between the working chambers CI–CIII at the outer surface of the membrane 27 and the space 47 at the inner surface of the membrane 27. A further purpose of the unit 50 is to avoid that lubricant is driven from the space 47 via the sealing assembly 40 due to the varying volume of the working chambers CI–CIII during operation of the motor.

The operation of the motor will now be explained with particular reference to FIGS. 3 and 4 showing the working chambers CI–CIII in an "unrolled" position thereof.

In FIG. 3 the helical longitudinal beads 29A–C of the membrane 27 are schematically represented as straight parallel lines 29A–C. The rollers RI–RV and the axes of rotation 26 thereof are schematically represented in phantom lines. It will be appreciated that one half of the roller RI is shown at the left side of the drawing and the other half thereof is shown at the right side of the drawing. The circular terminal beads 42 and 43 of the membrane 27 are schematically represented as horizontal boundary lines 42, 43. The inlet ports 30A–C extend along the upper terminal bead 42, and the exhaust ports 31A–C extend along the lower terminal bead 43. The inlet and exhaust ports 30A–C, 31A–C open into the working chambers CI–CIII over substantially the entire widths of the chambers.

The mud being supplied at high pressure via the inlet ports 30A–C into the working chambers CI–CIII (see arrows I) inflates those sections of the chambers that are in communication with these ports 30A–C. It is observed that these "high pressure" sections of the working chambers CI–CIII are able to expand since the liquid pressure of the lubricant being present in the space 47 at the other side of the membrane 27 is equal to the "low pressure" of the mud in the exhaust ports 31A–C. In FIGS. 3 and 4 the expanded "high pressure" sections of the chambers in which the mud pressure is equal to the mud pressure in the inlet ports 30A–C are indicated by a + sign. Further, the "low pressure" sections of the chambers CI–CIII, that are in communication with the exhaust ports 31A–C, are indicated by a − sign. In the position shown, the chamber CII is divided into a high and a low pressure section by roller RIII, which causes the roller RIII to roll (see arrow VI in FIG. 4) along the membrane 27 in front of the expanding high pressure section of this chamber CII, thereby rotating the carrier body 15 in the direction of arrow V and urging the mud being present in the low pressure section of the chamber CII to be discharged via the exhaust port 31B (see arrows III). The chambers CI and CIII are divided into high and low pressure sections by the roller RII and RV, respectively, which causes these rollers RII, RV to roll (see arrows VI) along the membrane 27 in front of the high pressure sections of these chambers CI and CIII, thereby moving the carrier body in the direction of arrow V and urging the mud being present in the low pressure sections of these chambers CI and CIII to be discharged via the exhaust ports 31A–C thereof.

It is observed that the part of the chamber CI extending between the rollers RI and RII is at high pressure since the mud being "locked up" in this part has previously been injected at high pressure via the inlet port 30A and no communication has been established as yet between this part of chamber CI and the exhaust port 31A.

It is furthermore observed that in the position of the rotor shown in FIGS. 3 and 4 the rollers RI and RIV are "inoperative" since these rollers do not divide any chamber into a high and a low pressure section. Hence these rollers RI, RIV are urged to roll over the membrane 27 by the rotation (see arrow V) of the carrier body 15, which rotation is induced by the "operative" rollers RII, RIII and RV. It will be appreciated that during operation of the motor each of the rollers RI–RV will be alternatingly operative and inoperative. The arrangement of a number of rollers being unequal to the number of working chambers ensures that in any angular position of the rotor relative to the stator at least one of the rollers is operative such that the occurrence of a "dead" position of the rotor is eliminated.

A smooth operation of the motor can also be ensured by providing the motor with a series of motor units, each unit comprising a membrane and a set of rollers cooperating therewith, the membranes of the various units being arranged in an elongate tubular stator housing, wherein the set of rollers of each unit is supported by its own, separate, carrier body and wherein the various carrier bodies are mounted in angularly off-set positions on a common shaft.

The arrangement in the motor according to the invention of a set of rollers that are rotatably supported in grooves of a carrier body allows the use of elongate rollers without the risk of bending of the rollers under the forces exerted thereon by the membrane such that the motor may have an extremely high volume-diameter ratio.

It will be appreciated that, if desired, the bearing assembly 9 for supporting the output shaft 6 may be arranged in—or be in fluid communication with—the space 47 at the inner side of the membrane 27.

It will further be appreciated that in an alternative design of the motor assembly according to the invention the carrier body and the rollers may form part of the stator; and the tubular section and the membrane may form part of the rotor. In such an alternative motor assembly the rollers may be arranged at the inner circumference of a carrier body that forms part of a stator housing, wherein the rollers cooperate with a membrane being secured to the outer circumference of a tubular section of the rotor. This tubular section may be formed by a hollow shaft in which mud channels are created that communicate with the working chambers via radially extending inlet and exhaust ports.

Finally, it will be appreciated that besides using the downhole motor according to the invention for driving a drill bit, the motor may also be used for driving other rotary down-hole tools, such as a core bit and an electric generator.

I claim as my invention:

1. Peristaltic motor comprising motor parts including a stator suitable to be operatively coupled to the lower end of a drill string and a rotor suitable to be operatively coupled to a drill bit, said motor parts being rotatable relative to each other about a central axis, one of said motor parts comprising a co-axial tubular section and a single membrane being secured to said section in such a manner that therebetween a series of breathing working chambers are created, the other of said motor parts comprising a carrier body having grooves therein and a plurality of rollers of a number greater than the number of working chambers, each of said rollers contacting the membrane at regular intervals with said tubular section, wherein the rollers are rotatably supported in said grooves of the carrier body such that each roller is rotatable relative to said carrier body about an axis of rotation being substantially parallel to and at a fixed distance from the central axis of the motor.

2. The motor as claimed in claim 1, wherein the carrier body is at least partly made of a low friction bearing material, such as bronze.

3. The motor as claimed in claim 1, wherein the carrier body and the membrane are positioned in a manner such that a space is defined between said elements, and said space is filled with a lubricant.

4. The motor as claimed in claim 3, wherein each breathing working chamber comprises circumferentially spaced inlet and exhaust ports.

5. The motor as claimed in claim 4, wherein means are provided for equalizing the liquid pressure of the lubricant to the fluid pressure in the exhaust ports.

6. The motor as claimed in claim 1, wherein the membrane is secured to said tubular section in such a manner that the working chambers have the shape of helical strips.

7. Peristaltic motor comprising motor parts including a stator suitable to be operatively coupled to the lower end of a drill string and a rotor suitable to be operatively coupled to a drill bit, said motor parts being rotatable relative to each other about a central axis, one of said motor parts comprising a co-axial tubular section and a membrane being secured to said section in such a manner that therebetween a series of breathing working chambers are created, the other of said motor parts comprising a carrier body having grooves therein and a plurality of rollers contacting the membrane at regular intervals with said tubular section, wherein the rollers are rotatably supported in said grooves of the carrier body such that each roller is rotatable relative to said carrier body about an axis of rotation being substantially parallel to the central axis of the motor, wherein the carrier body and the membrane are positioned in a manner such that a space is defined between said elements, and said space is filled with a lubricant, wherein each breathing working chamber comprises circumferentially spaced inlet and exhaust ports, and wherein the membrane extends in axial direction between a pair of circular terminal beads, the inlet ports extending along one of said beads over substantially the entire widths of the working chambers, the exhaust ports extending along the other bead over substantially the entire widths of the working chambers.

8. The motor as claimed in claim 7, wherein the carrier body is at least partly made of a low friction bearing material, such as bronze.

9. The motor as claimed in claim 7, wherein means are provided for equalizing the liquid pressure of the lubricant to the fluid pressure in the exhaust ports.

10. The motor as claimed in claim 7, wherein the membrane is secured to said tubular section in such a manner that the working chambers have the shape of helical strips.

11. The motor as claimed in claim 7, wherein the tubular section and the membrane form part of the stator and wherein the carrier body and the rollers form part of the rotor, the rollers being supported in axial direction by means of co-axial support rings forming part of the stator.

12. Peristaltic motor comprising motor parts including a stator suitable to be operatively coupled to the lower end of a drill string and a rotor suitable to be operatively coupled to a drill bit, said motor parts being rotatable relative to each other about a central axis, one of said motor parts comprising a co-axial tubular section and a membrane being secured to said section in such a manner that therebetween a series of breathing working chambers are created, the other of said motor parts comprising a carrier body having grooves therein and a plurality of rollers contacting the membrane at regular intervals with said tubular section, wherein the rollers are rotatably supported in said grooves of the carrier body such that each roller is rotatable relative to said carrier body about an axis of rotation being substantially parallel to the central axis of the motor, and wherein the tubular section and the membrane form part of the stator and wherein the carrier body and the rollers form part of the rotor, the rollers being supported in axial direction by means of co-axial support rings forming part of the stator.

13. The motor as claimed in claim 12, wherein the carrier body is at least partly made of a low friction material, such as bronze.

14. The motor as claimed in claim 12, wherein the membrane is secured to said tubular section in such a manner that the working chambers have the shape of helical strips.

15. The motor as claimed in claim 12, wherein the carrier body and the membrane are positioned in a manner such that a space is defined between said elements, and said space is filled with a lubricant.

16. The motor as claimed in claim 15, wherein each breathing working chamber comprises circumferentially spaced inlet and exhaust ports.

17. The motor as claimed in claim 16, wherein means are provided for equalizing the liquid pressure of the lubricant to the fluid pressure in the exhaust ports.

18. The motor as claimed in claim 16, wherein the membrane extends in axial direction between a pair of circular terminal beads, the inlet ports extending along one of said beads over substantially the entire widths of the working chambers, the exhaust ports extending along the other bead over substantially the entire widths of the working chambers.

* * * * *